US006533601B2

(12) United States Patent
Raudenbush et al.

(10) Patent No.: US 6,533,601 B2
(45) Date of Patent: Mar. 18, 2003

(54) ELECTRICAL CONNECTOR ASSEMBLY WITH A LATERALLY DEFLECTABLE LATCH MEMBER AND CPA

(75) Inventors: James Michael Raudenbush, Halifax, PA (US); John Wesley Hall, Jr., Harrisburg, PA (US)

(73) Assignee: Tyco Electronics Corporation, Middleton, PA (US)

( * ) Notice: Subject to any disclaimer, the term of this patent is extended or adjusted under 35 U.S.C. 154(b) by 0 days.

(21) Appl. No.: 09/780,296

(22) Filed: Feb. 9, 2001

(65) Prior Publication Data

US 2002/0111059 A1 Aug. 15, 2002

(51) Int. Cl.[7] ..... H01R 13/627
(52) U.S. Cl. ..... 439/352; 439/354
(58) Field of Search ..... 439/352, 350, 439/345, 353, 354, 489

(56) References Cited

U.S. PATENT DOCUMENTS 4,655,527 A * 4/1987 Vandame ..... 439/353
5,015,199 A * 5/1991 Hirano et al. ..... 439/350
5,391,090 A * 2/1995 Power ..... 439/354
5,591,041 A * 1/1997 Cecil, Jr. et al. ..... 439/352
5,628,648 A * 5/1997 Higgins, Jr. et al. ..... 439/352
5,643,003 A 7/1997 Raudenbush ..... 439/352
5,647,757 A * 7/1997 Chrysostomou ..... 439/352
5,651,689 A 7/1997 Flyer et al. ..... 439/352
5,853,298 A * 12/1998 Pacher ..... 439/352
6,004,153 A 12/1999 Myer et al. ..... 439/352
6,065,991 A * 5/2000 Fukuda ..... 439/352
6,146,180 A * 11/2000 Betker et al. ..... 439/352

OTHER PUBLICATIONS

U.S. patent application Ser. No. 09/752,789, Marpoe, Jr. et al., filed Dec. 28, 2000.
U.S. patent application Ser. No. 09/785,369, Myer et al., filed Feb. 16, 2001.

* cited by examiner

*Primary Examiner*—Gary Paumen
*Assistant Examiner*—Felix O. Figueroa

(57) ABSTRACT

An electrical connector assembly is provided having a connector position assurance device (CPA) and a plug and header that have mating interfaces that interconnect to form an electrical connection therebetween. A deflectable latch assembly is mounted on an exterior surface of one of the plug and header and comprises at least one latch beam that is deflectable from side-to-side relative to the plug and header along an axis transverse to the direction of engagement between the plug and header. A CPA is provided having a beam blocking portion that blocks lateral movement of the latch assembly.

15 Claims, 18 Drawing Sheets

ELECTRICAL CONNECTOR ASSEMBLY WITH A LATERALLY DEFLECTABLE LATCH MEMBER AND CPA

CROSS REFERENCE TO RELATED APPLICATIONS (if applicable)

Not applicable.

STATEMENT REGARDING FEDERALLY SPONSORED RESEARCH & DEVELOPMENT (if applicable)

Not applicable.

BACKGROUND OF THE INVENTION

The preferred embodiments of the present invention generally relate to an electrical connector assembly that includes a connector position assurance device (CPA) for assuring that matable connectable halves, such as a header and plug, are fully mated with one another.

U.S. Pat. No. 5,643,003 discloses a connector assembly including a plug housing with a housing latch formed thereon that includes grooves for slidably receiving a connector position assurance device (CPA). The CPA is inserted from a mating side face of the housing and is operable to assure that a further matable connector is fully mated to the housing. The CPA includes a deflectable beam and an embossment. The beam will deflect below projections of a latch as the CPA is moved into its final position. When the CPA is in its final position, the operator can readily observe that the housing has been fully mated to the further matable connector.

Another known CPA is disclosed in U.S. Pat. No. 5,651,689. The '689 patent discloses an electrical connector assembly that employs a CPA to detect and interlockably secure complete mating of a pair of electrical connectors. The CPA includes a yolk which traps a cantilevered beam to a locking member. A flexible arm is mounted to the yolk and extends between a pair of cantilevered beams. The yolk traps the cantilevered beam to a locking member.

While conventional CPAs achieve their basic objectives of insuring that two connectors are fully mated with one another, as with most technologies, it is desirable to develop improvements and alternative designs. It is believed that the preferred embodiments of the present invention provide such improvements and alternatives to conventional CPA designs.

BRIEF SUMMARY OF THE INVENTION

An electrical connector assembly is provided including a connector position assurance device (CPA) and first and second connector housings arranged along a connector assembly mating longitudinal axis. The first and second connector housings each have rear ends and mating interfaces arranged orthogonal to, and located along, the longitudinal axis. The assembly includes a deflectable latch assembly mounted on an exterior surface of one of the first and second connector housings. The latch assembly includes at least one latch beam that is deflectable from side-to-side relative to the exterior surface and along an axis transverse to the longitudinal axis between latched and unlatched positions. A CPA is provided having a beam blocking portion movable between first and second positions relative to the latch beam. The beam blocking portion is spaced laterally remote from the latch beam when in the first position to permit lateral deflection of the beam along the transverse axis. The beam blocking portion is moved to a position immediately adjacent the latch beam when in the second position to prevent lateral deflection of the latch beam along the transverse axis.

In accordance with at least one alternative embodiment, the latch beam includes a pair of latch beams formed at one end of a plug connector housing. The latch beams extend parallel to the longitudinal axis when in a rest position and are deflectable laterally away from one another in opposite directions along the transverse axis. In accordance with an alternative embodiment, the latch assembly includes a single latch beam centrally located on one of a plug and header housing. The single latch beam has one end mounted on one of the plug and header housing. The single latch beam extends parallel to the longitudinal axis when in a resting non-deflected position and is laterally deflectable in either direction along the transverse axis. The latch beam includes a latch member that latches an associated latch element on one of the first and second connector housings when in the beams resting non-deflected position. The latch member is moved along an arcuate path that substantially follows the transverse axis to engage and disengage the latch element.

In accordance with at least one alternative embodiment, the first and second connector housings include a header having a pair of latch projections spaced apart from one another along the transverse axis. The latch beam includes latch projections formed on opposed outer sides thereof and arranged to be biased outward into an engaging relation with the latch projections when the first and second connector housings are fully mated with one another. The first and second connector housings may also include a header having a pair of latch elements extending downward from an interior surface of a top wall of the header. A pair of beams may be provided having latch projections arranged to be biased into an engaging relation with the latch elements when the pair of beams are located in resting non-deflected positions. At least one latch beam may have an outer end with a notch formed in an upper surface thereof. The notch may be laterally moved to engage a latch tooth located on an interior surface of the top wall of one of the first and second connector housings. The latch beam is moved laterally with respect to the longitudinal axis to disengage the notch from the tooth. In at least one embodiment having two latch beams, the beams may be formed with front and back portions that are arranged, with the back portions being flared away from one another to define a CPA pre-staging area therebetween that holds the CPA while in the first position. The front portions of the beams define a CPA fully mated area therebetween holding the CPA while in the second position.

In at least one alternative embodiment, the beam blocking portion on the CPA include a V-shaped notch therein with one angled side divided into a blocking surface and a limit surface. The limit surface is located laterally remote from the latch beam when the latch beam is in the rest position permitting the latch beam to move laterally when the CPA is in its first position. The blocking surface is movable to a position immediately adjacent the latch beam when the latch beam is in its rest position, thereby holding the latch beam firmly in the latched position when the CPA is in the second position.

In accordance with at least one alternative embodiment, an electrical connector assembly is provided including a header, a connector position assurance device (CPA), and a plug. The header and plug have mating interfaces and rear ends. The header and plug include at least one contact interconnection therebetween when fully mated. The assembly includes a plug/header latch assembly mounted to one of the plug and header. The latch assembly has at least one latch arm normally biased in a first latch position and pivotal along an arcuate path to a second latch position to engage and disengage, respectively, a latch member on one of the header and plug when moved between the first and second positions. The assembly further includes a CPA that is slidably mounted to one of the plug and header and is movable between first and second CPA positions relative to the latch assembly relative to the latch assembly. The CPA is movable along a length of the latch arm when moved between the first and second CPA positions. The CPA is based from the latch arm when in the first CPA position, thereby permitting the latch arm to move to the second latch position. The CPA is moved to a position spaced immediately adjacent the latch arm when in the second CPA position, thereby blocking movement of the at least one latch arm from the first latch position.

Figure 1:
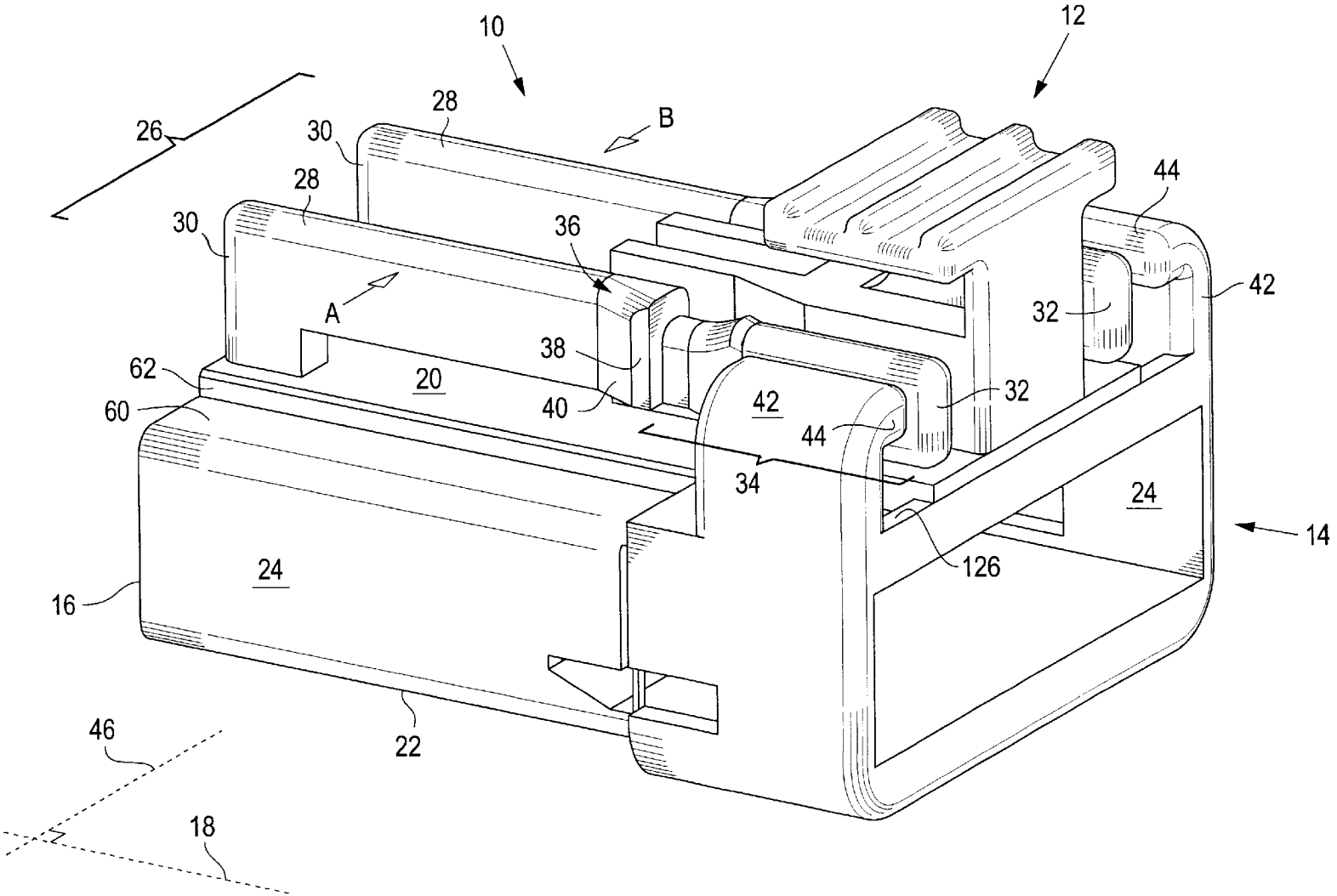
FIG. 1 illustrates an isometric view of a plug and CPA assembly formed in accordance with a preferred embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are present preferred. It should be understood, however, that the present invention is not limited to the precise arrangements and instrumentality shown in the attached drawings.

DETAILED DESCRIPTION OF THE INVENTION

FIG. 1 illustrates an isometric view of a plug housing 10 and CPA 12 formed in accordance with a preferred embodiment of the present invention. The plug housing 10 includes a wire receiving rear end 14 and a mating end 16 formed at opposite ends of the plug housing 10 along a longitudinal axis 18 extending along the mating direction. The plug housing 10 includes top and bottom surfaces 20 and 22, respectively and side walls 24 formed continuous with one another. The top surface 20 includes a latch assembly 26 mounted thereon and aligned parallel to the longitudinal axis 18.

The latch assembly 26 includes a pair of latch beams 28 having proximal ends 30 attached to the top surface 20. The latch beams 28 extend parallel to one another and parallel to the longitudinal axis 18 of the plug housing 10. The proximal ends 30 are located near the mating end 16, while distal ends 32 of the latch beams 28 are located proximate the wire receiving rear end 14. The latch beams 28 further include CPA retention portions 34 located between the proximal and distal ends 30 and 32, but near the distal ends 32. At least one latch beam 28 includes a latch projection 36 having a stop surface 38 and ramped surface 40. The latch projections 36 are formed on the outer sides of the latch beams 28 and are directed outward therefrom.

The plug housing 10 further includes posts 42 located proximate the wire receiving rear end 14 and extending upward from either side wall 24. The posts 42 are L-shaped, have stop limit surfaces 44 on the outer ends thereof and are directed toward one another. The stop limit surfaces 44 are aligned with the CPA retention portions 34 on the latch beams 28. The stop limit surfaces 44 and posts 42 function to prevent the latch beams 28 from being laterally deflected outward from one another by an excessive amount beyond the necessary operating range of the latch assembly 26. The posts 42 prevent the latch beams 28 from being caught on foreign objects and overly flexed. The posts 42 also prevent foreign material from interfering with the latch beams 28.

The latch beams 28 normally rest in positions substantially parallel to one another and to the longitudinal axis 18 of the plug housing 10. The latch beams 28 are deflectable toward one another in lateral directions along a transverse axis 46. During an interconnection operation, the latch beams 28 are deflected inward toward one another in the directions indicated by arrows A and B until the latch projections 36 engage corresponding latching features (described below in more detail) on the header 50. Once the latch projections 36 engage corresponding latching features on the header 50, the latch beams 28 return to their normal rest positions substantially parallel to one another and to the longitudinal axis 18.

Figure 2:
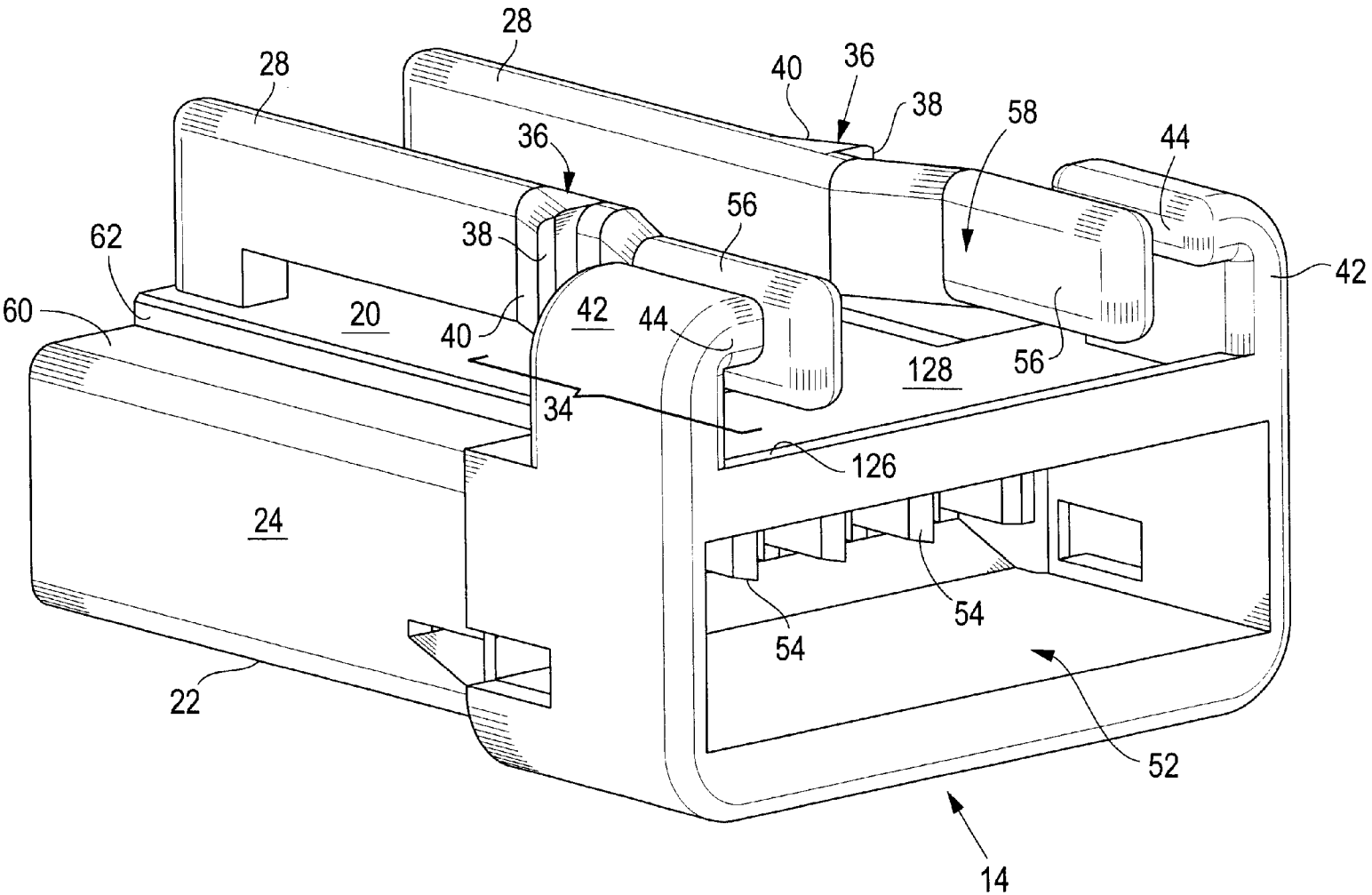
FIG. 2 illustrates an isometric view of a plug housing formed in accordance with a preferred embodiment of the present invention.

FIG. 2 illustrates the plug housing 10 in more detail with the CPA 12 removed. The wire receiving rear end 14 includes a cavity 52 housing a plurality of contact receptacles 54 into which contacts and associated wires are loaded. As also illustrated in FIG. 2, the CPA retention portions 34 include flared end walls 56 that extend parallel to another and are located further from one another than the remaining portion of the latch beams 28. The flared end walls 56 define a CPA pre-staging region 58 that holds the CPA 12 before the plug housing 10 and header 50 are mated.

The top surface 20 of the plug housing 10 includes recessed ledges 60 extending along either side of the plug housing 10. The recessed ledges 60 cooperate with corresponding features in the header 50 to ensure proper alignment between the plug housing 10 and header 50.

Figure 3:
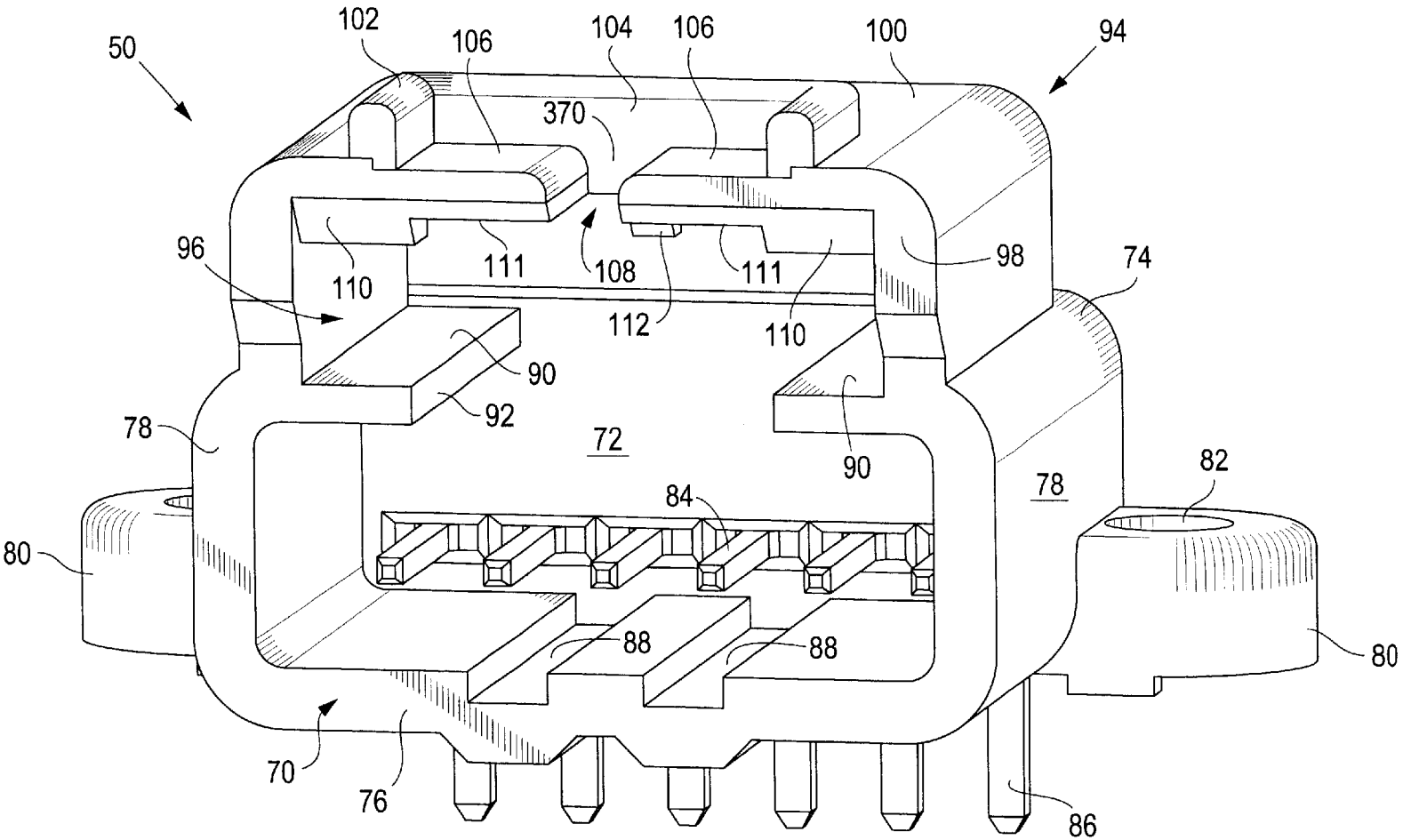
FIG. 3 illustrates an isometric view of a header assembly formed in accordance with a preferred embodiment of the present invention.

FIG. 3 illustrates an isometric view of the header 50. The header 50 includes a mating end 70 and a rear end 72. The header 50 includes a top wall 74, bottom wall 76 and side walls 78. Brackets 80 are mounted to the side walls 78 and have holes 82 therethrough. The brackets 80 and holes 82 enable the header 50 to be mounted to a support structure through any suitable fastening means. The rear wall 72 includes a plurality of electrical posts 84 extending forward therefrom and aligning with the contact receptacles 54 on the plug housing 10. The electrical posts 84 electrically connect with contacts mounted to the contact receptacles 54 when the plug housing 10 and header 50 are joined in a fully mated position. The electrical posts 84 communicate with electrical pins 86 extending downward from the header 50 and that, in turn, are connected with wires, electrical paths and the like. The bottom wall 76 includes channels 88 cut therein and extending in a direction parallel to the mating direction of the header 50. The mating direction corresponds to the longitudinal axis 18 of the plug housing 10. The channels 88 slidably receive grooves (not shown) formed in the bottom surface 22 of the plug housing 10.

The top wall 74 includes a pair of lateral ledges 90 extending inward from either side of the header 50 and facing one another. The ledges 90 slidably engage the recessed ledges 60 on either side of the top surface 20 of the plug housing 10. The ledges 90 include guide surfaces 92 that slidably engage guide surfaces 62 on the plug housing 10. The top wall 74 further includes a shroud 94 mounted thereon and defining a cavity 96 that receives the latch assembly 26. The shroud 94 includes a mating face 98 and a top wall 100. The top wall 100 includes a U-shaped rib 102 formed thereon. A notch 104 is cut in the top wall 100 within the rib 102. The notch 104 is bordered by fingers 106 extending inward toward one another. A pair of embossments 110 are formed on the lower surface of the top wall 100 and located proximate opposite sides thereof near the mating face 98. The embossments 110 have a ramped surface facing the mating face 98 and a stop surface facing the rear wall 74. At least one of the fingers 106 includes a latching projection 112 extending downward therefrom and located proximate an outer end of the finger 106. The embossments 110 and latch projection 112 operate with different embodiments of the present invention to latch the plug housing 10 and header 50 to one another.

Figure 4:
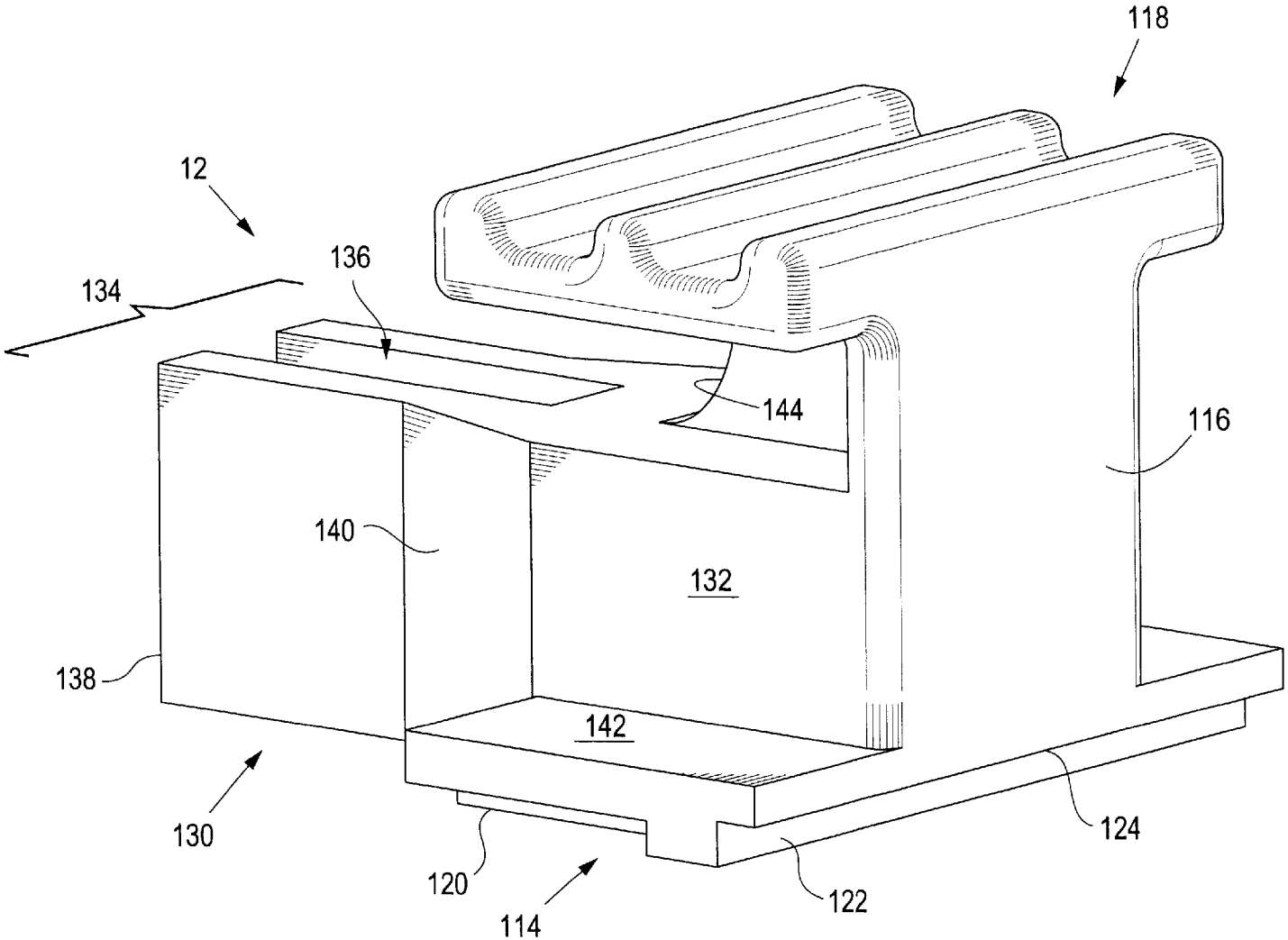
FIG. 4 illustrates an isometric view of a CPA formed in accordance with a preferred embodiment of the present invention.
Figure 9:
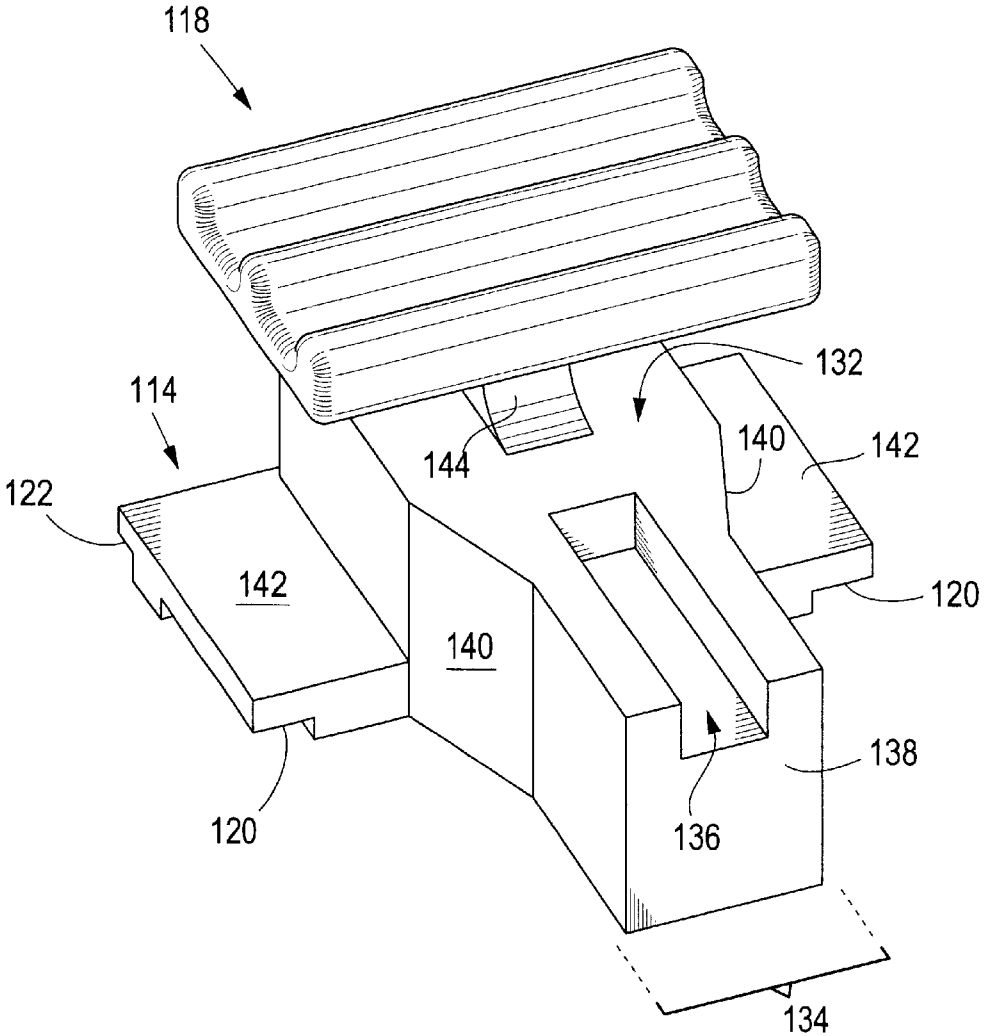
FIG. 9 illustrates an isometric view of a CPA formed in accordance with a preferred embodiment of the present invention.

FIGS. 4 and 9 illustrate isometric views of the CPA 12 in more detail. The CPA 12 includes a base 114 mounted to a vertical post 116. The upper end of the vertical post 116 includes a ribbed platform 118 that is engaged by the operator to move the CPA 12 forward and backward. The base 114 includes longitudinal and lateral notches 120 and 122 cut therein. The longitudinal notches 120 are formed along either side of the bottom surface of the base 114 while the lateral notch 122 extends along the rear end 124 of the base 114. The lateral notch 122 engages a ledge 126 formed along the rear end 14 of the plug housing 10. Once the CPA 12 is mounted on the plug housing 10, the base 114 drops into a pocket 128 on the top surface 20 between the post 42 and ledge 126. The ledge 126 prevents the CPA 12 from being entirely removed from the plug housing 10 once the CPA 12 is inserted into its pre-staged position within pocket 128. The CPA 12 further includes a wedge shaped body 130 having a main section 132 and a forked outer section 134. The forked outer section 134 includes a notch 136 cut therein and extending rearward from the front face 138 of the CPA 12. The main section 132 has a width greater than the width of the forked outer section 134, with the main and forked sections 132 and 134 being joined by beveled surfaces 140. The base 114 extends laterally beyond the main section 132 to define wings 142 on either side of the CPA 12. The post 116 is formed with a T-shaped cross-section having a curved front face 144.

Figure 5:
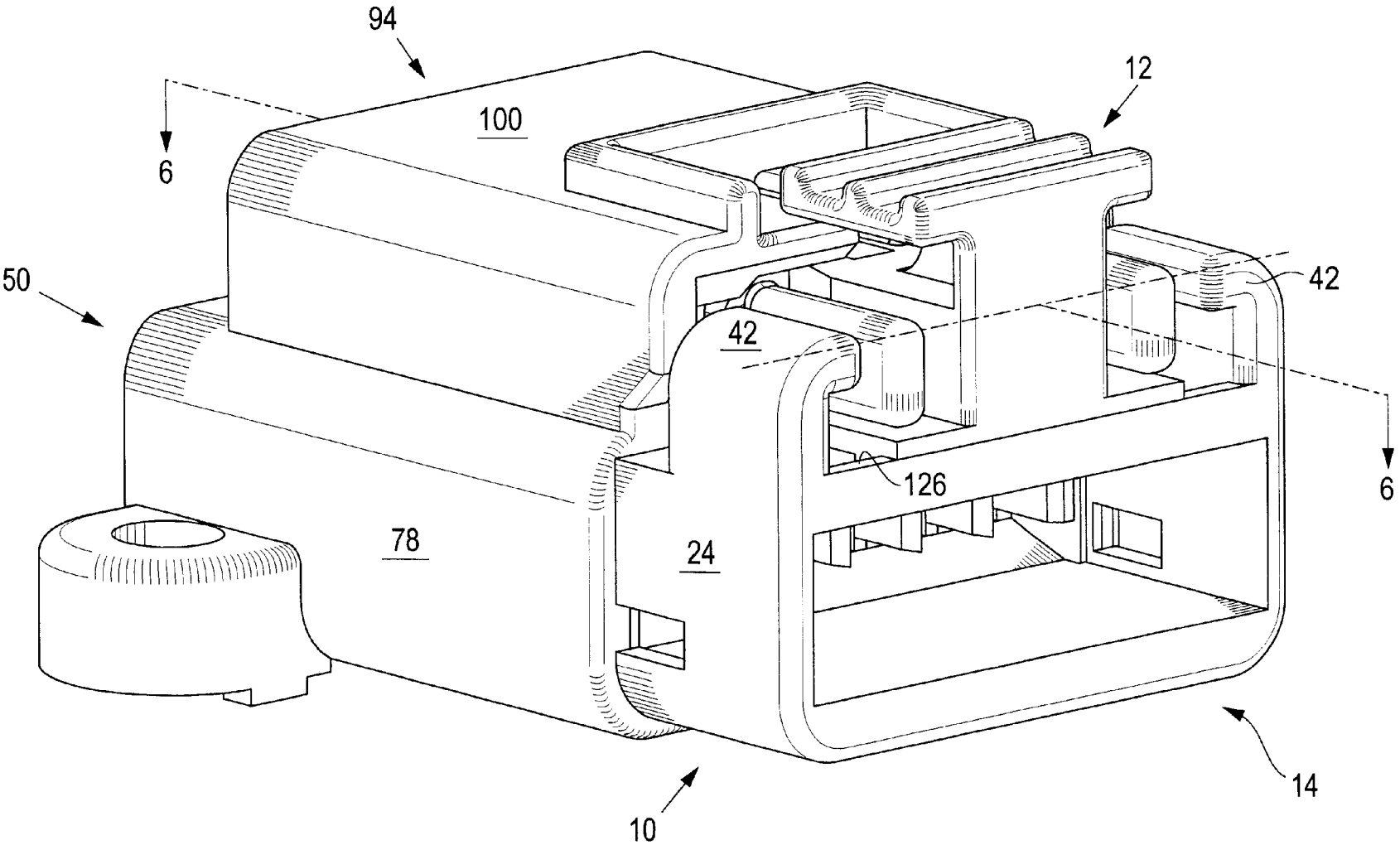
FIG. 5 illustrates a plug, header and CPA assembly interconnected in a pre-staged, fully mated position in accordance with a preferred embodiment of the present invention.
Figure 6:
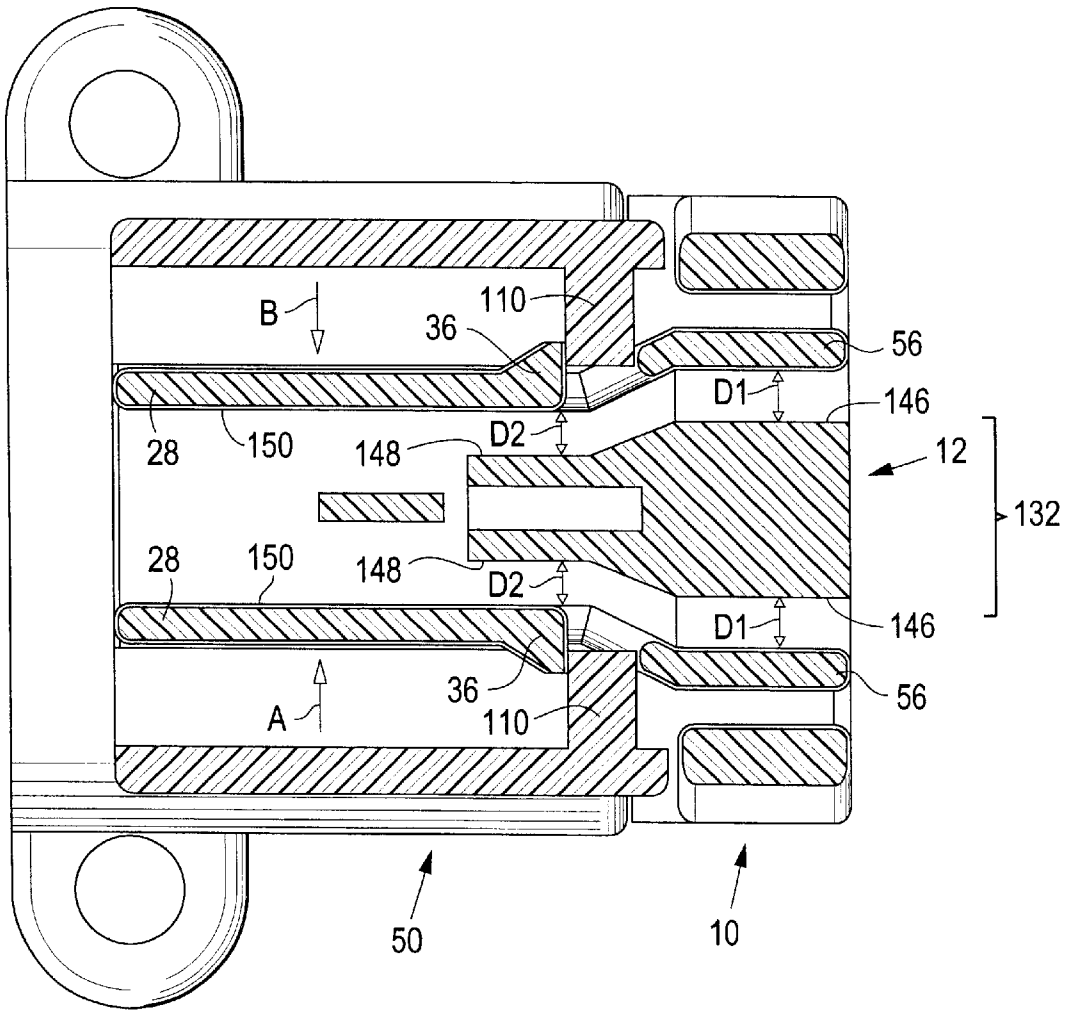
FIG. 6 illustrates a sectional view taken along line 6—6 in FIG. 5 illustrating a top plan view of a header, plug and CPA formed in accordance with a preferred embodiment of the present invention.

FIG. 5 illustrates an isometric view of the plug housing 10 and header 50 joined in a fully mated position, while the CPA 12 is located in an initial pre-staged position. FIG. 6 illustrates a sectional view taken along line 6—6 in FIG. 5 showing a top plan view of the plug housing 10 and header 50, with the top wall 100 of the shroud 94 removed. As shown in FIGS. 5–6, the CPA 12 is located with the main section 132 disposed between the flared end walls 56. The CPA main sides 146 are spaced a distance D1 from the end walls 56. The CPA outer sides 148 are spaced a distance D2 from the interior side surfaces 150 of the latch beams 28. The distances D1 and D2 are sufficient to permit the latch beams 28 to be deflected in the direction of arrows A and B when the header 50 and plug housing 10 are joined in a mated relation. Once the header 50 and plug housing 10 are fully mated, the latch projections 36 snap behind the embossments 110, thereby permitting the latch beams 28 to be deflected outward to their rest positions as illustrated in FIG. 6. Once the plug housing 10 and header 50 are fully mated, the CPA 12 may be moved to its engaged position as illustrated in FIGS. 7 and 8.

Figure 7:
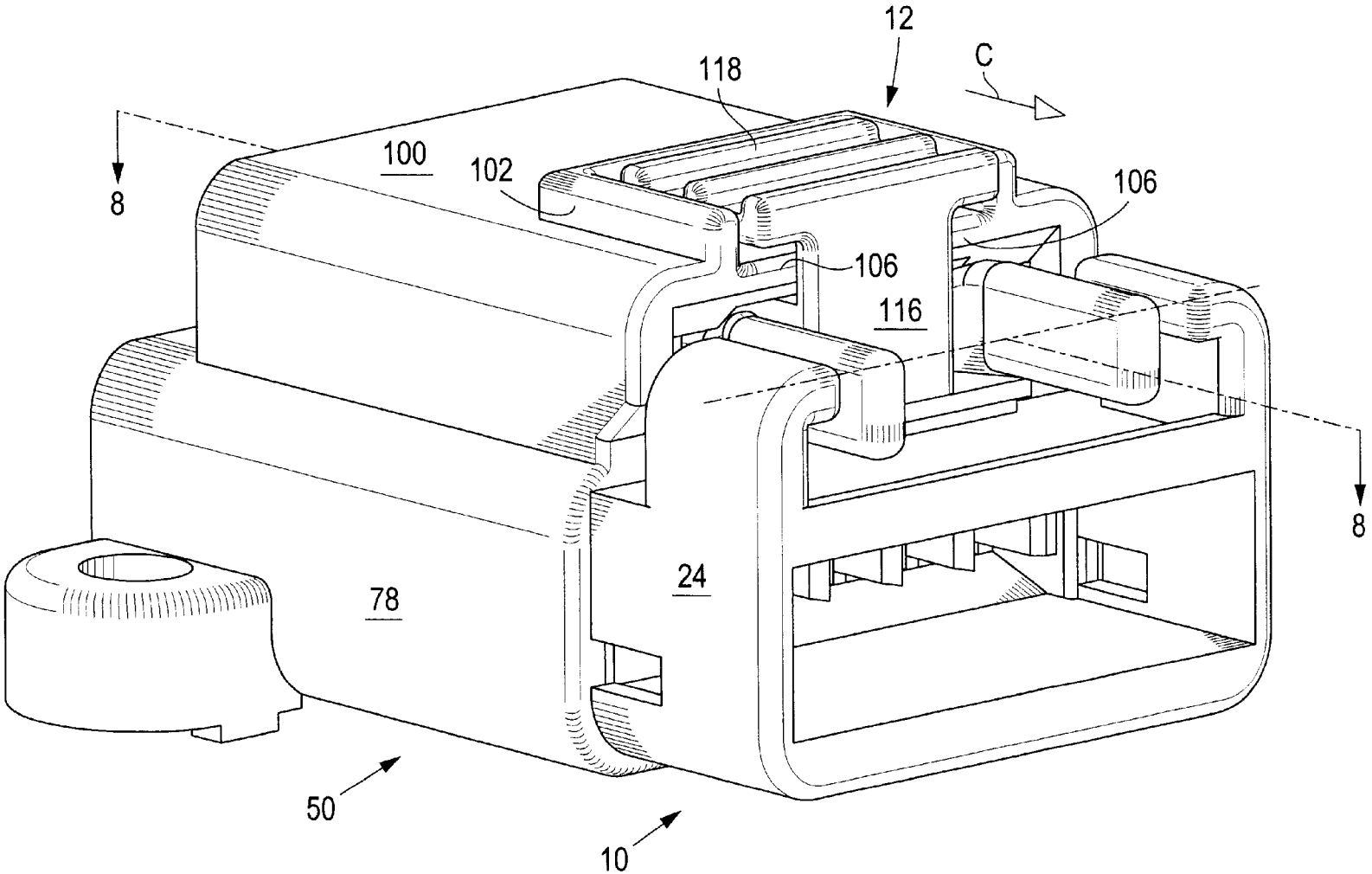
FIG. 7 illustrates an isometric view of a plug, header and CPA while in a fully mated fully locked position in accordance with a preferred embodiment of the present invention.
Figure 8:
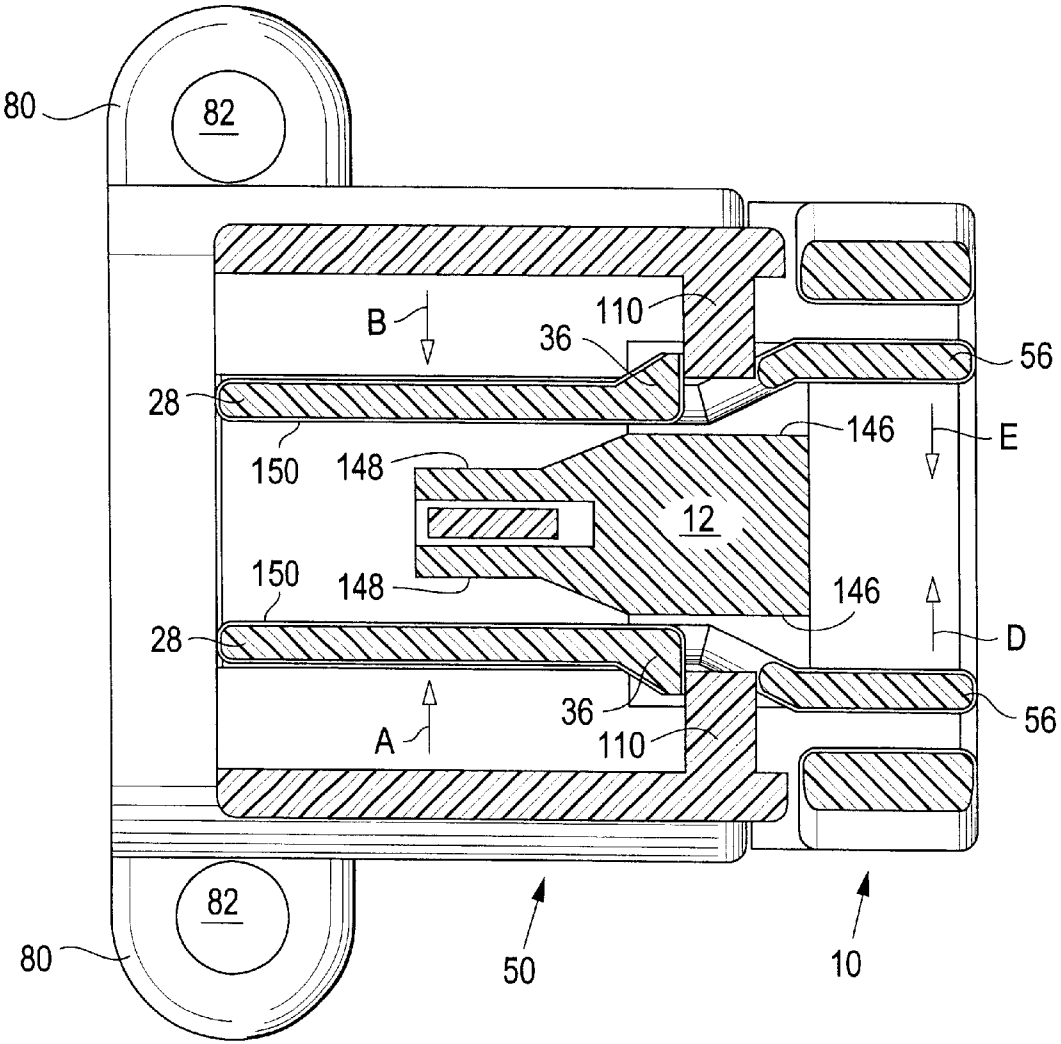
FIG. 8 illustrates a sectional view taken along line 8—8 in FIG. 7 of a plug, header and CPA formed in accordance with a preferred embodiment of the present invention.

FIG. 7 illustrates an isometric view of a plug housing 10 fully mated with a header 50, and in which the CPA 12 is moved to its locked position. FIG. 8 illustrates a sectional view taken along line 8—8 in FIG. 7 showing a top plan view of the plug housing 10, header 50 and CPA 12 configuration of FIG. 7. Once the CPA 12 is moved to its locked position the CPA main side walls 146 are located immediately adjacent the interior side surfaces 150 of the latch beams 28. The CPA main side walls 146 prevent the latch beams 28 from being deflected inward in the direction of arrows A and B. When moving the CPA 12 from its initial pre-staged position (FIGS. 5–6) to its final locked position (FIGS. 7–8), the CPA 12 is moved forward until the front sides of the post 116 engage the fingers 106. When the CPA 12 is in its final locked position, the ribbed platform 18 is received within the U-shaped rib 102. Fingers 106 support the platform 118.

To disengage the plug housing 10 from the header 50, the CPA 12 is first slid backwards in the direction of arrow C (FIG. 7) by the user pressing on the platform 118. Once the CPA 12 is moved to the position shown in FIG. 6, the flared end walls 56 are squeezed inward towards one another in the directions of arrows D and E until the latch projections 36 move toward one another to slip past the embossments 110. Thereafter, the plug housing 10 may be removed from the header 50.

Figure 10:
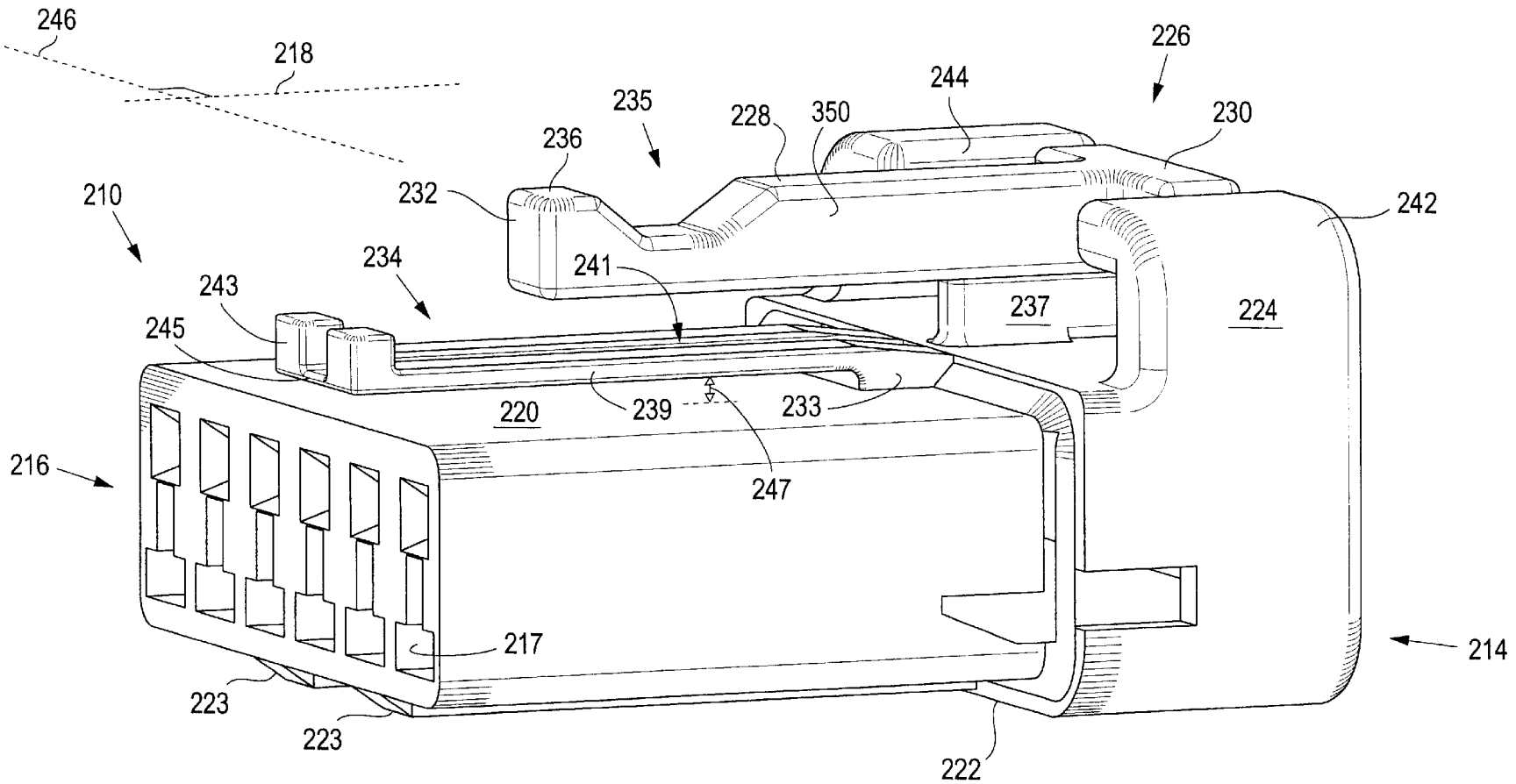
FIG. 10 illustrates an isometric view of a plug housing formed in accordance with an alternative embodiment of the present invention.

FIG. 10 illustrates a plug housing 210 in accordance with an alternative embodiment of the present invention. The plug housing 210 includes a wire receiving rear end 214 and a mating end 216 located at opposite ends of the plug housing 210 extending along a longitudinal axis 218. The longitudinal axis 218 represents the path along which the plug housing 210 and the header 50 are moved toward one another to form a mating connection therebetween. The plug housing 210 includes a top surface 220, bottom surface 222 and side walls 224. A latch assembly 226 is mounted to the top surface 220. The latch assembly 226 includes a single latch beam 228 having a proximal end 230 and a distal end 232. A latching notch 235 is cut out of the top surface in the latch beam 228 near the distal end 232. The proximal end 230 is mounted on the plug housing 210 through a pivot member 237 which permits the latch beam 228 to be deflected in a lateral direction, from side-to-side along a transverse axis 246. A CPA retention portion 234 is also formed on the top surface 220. The CPA retention portion 234 is mounted at base 233 to the top surface 220. The CPA retention portion 234 includes a pair of legs 239 extending toward the mating end 216 away from the base 233. The legs 239 are divided by a groove 241 and have vertical posts 243 extending upward from outer ends of the legs 239. The vertical posts 243 are divided by groove 241 and are joined by a cross member 245. A gap 247 is located between the legs 239 and the top surface 220 of the plug housing 210.

The plug housing 210 further includes limit posts 242 extending upward along either side of the latch assembly 226 and directed inward, in an L-shape at upper ends thereof to define stop limit surfaces 244. The stop limit surfaces 244 and limit posts 242 prevent excessive lateral deflection of the latch beam 228 and block foreign material from interfering with the operation of the plug housing 210.

The mating end 216 includes contact apertures 217. The bottom surface 222 includes a pair of ridged runners 223 extending along the bottom of the plug housing 210 in a direction substantially parallel to the longitudinal axis 218. The runners 223 are received within the channels 88 in the bottom wall 76 of the header 50.

Figure 11:
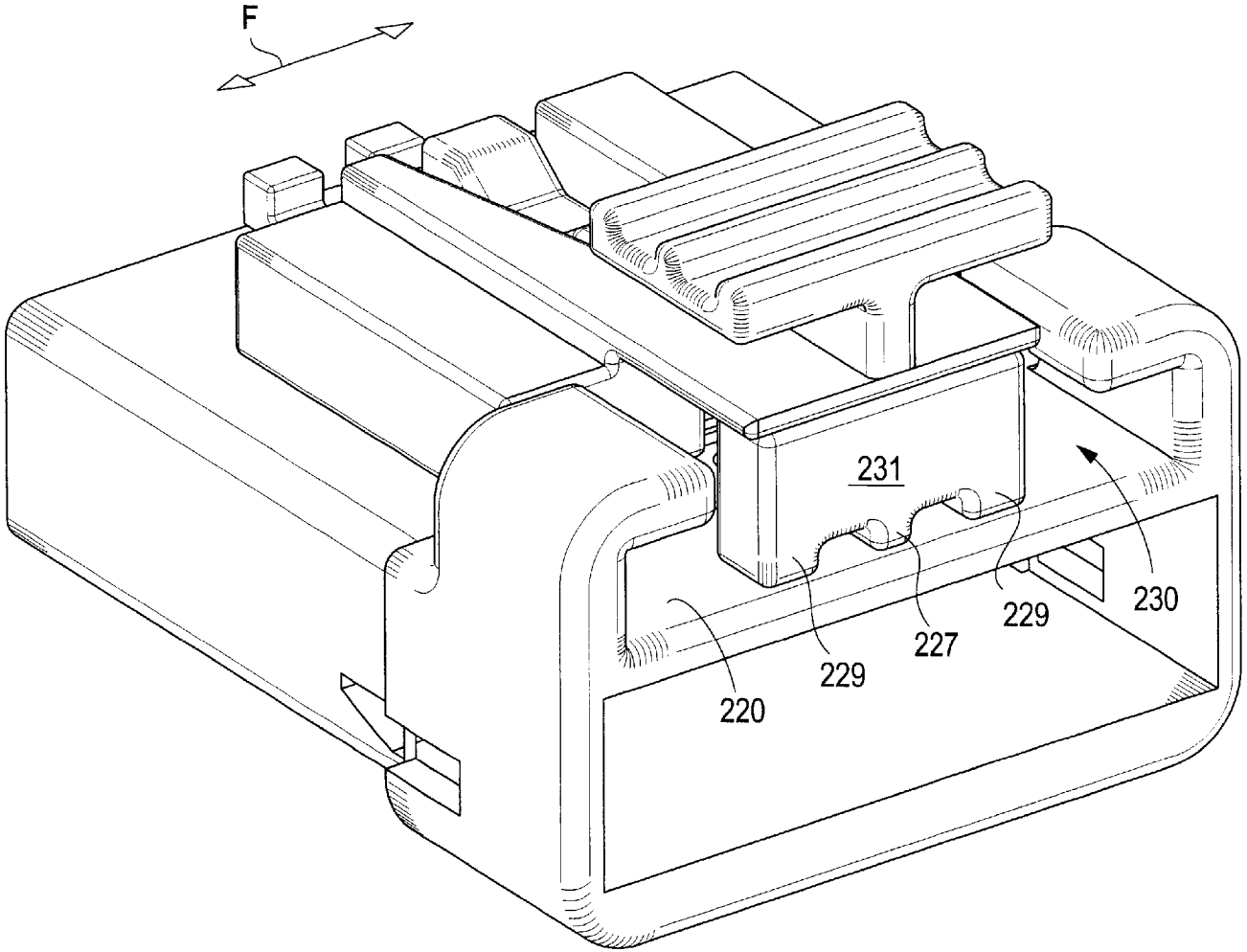
FIG. 11 illustrates an isometric view of a plug and CPA in an initial pre-staged position in accordance with a preferred embodiment of the present invention.

FIG. 11 illustrates an isometric view of the plug housing 210 with a CPA 212 arranged thereon in an initial pre-staged position. As better illustrated in FIG. 11, the latch beam 228 includes at the proximal end 230 a cross beam 231 forming a T-shape with the latch beam 228. A base column 227 is centered laterally under the cross beam 231 and projects toward the top surface 220 of the plug housing 210. The base column 227 is not secured to the top surface 220, but instead rests on the top surface 227, while being movable side-to-side. The cross beam 231 also includes opposed embossments 229 located laterally from the base column 227 proximate either end of the cross beam 231. The embossments 229 project downward from the cross beam 231 to provide lateral support for the latch beam 228, while permitting the latch beam 228 to be transversely deflected in the direction of arrow F, from side-to-side, while preventing the latch beam 228 from being twisted about its axis.

Figure 12:
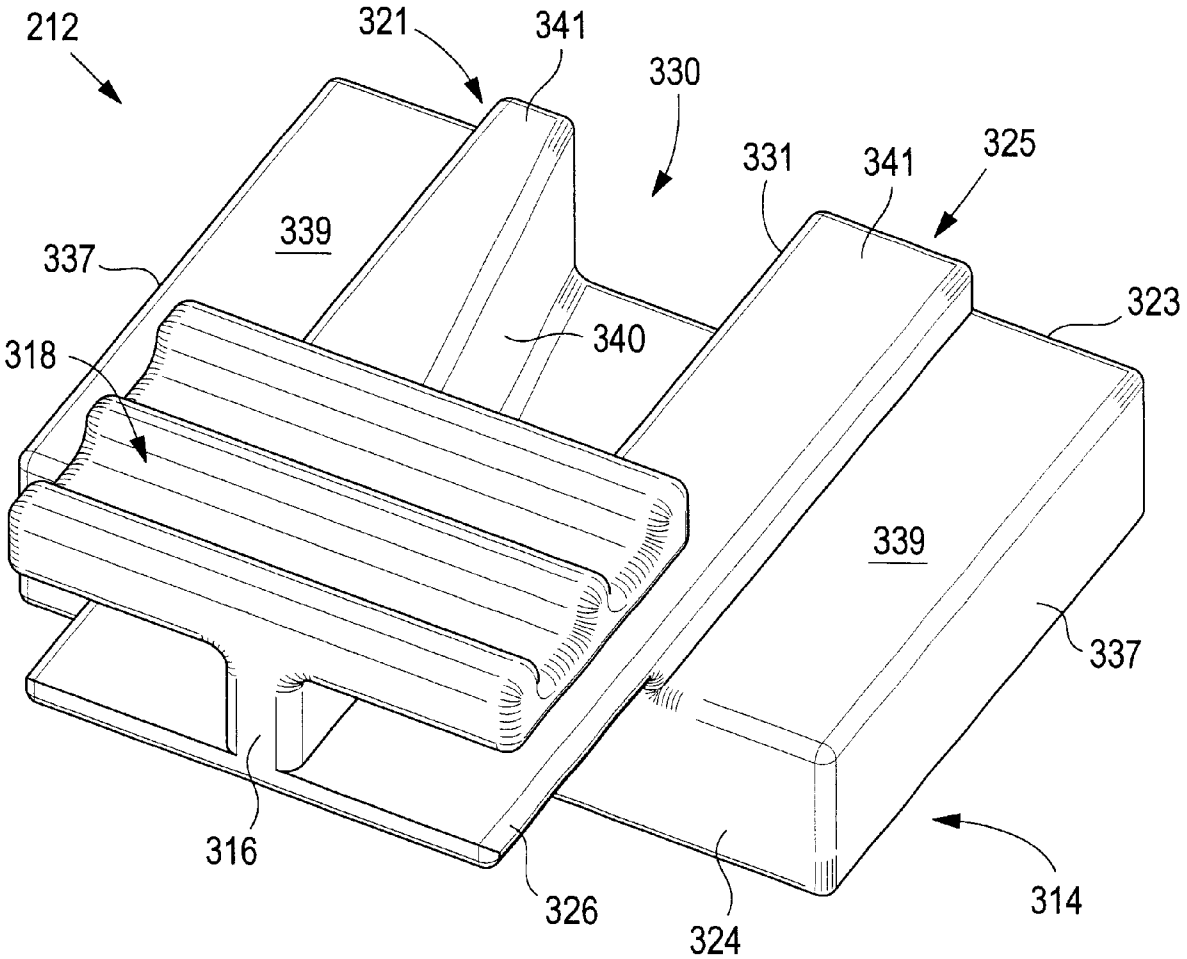
FIG. 12 illustrates an isometric top view of a CPA formed in accordance with an alternative embodiment of the present invention.
Figure 13:
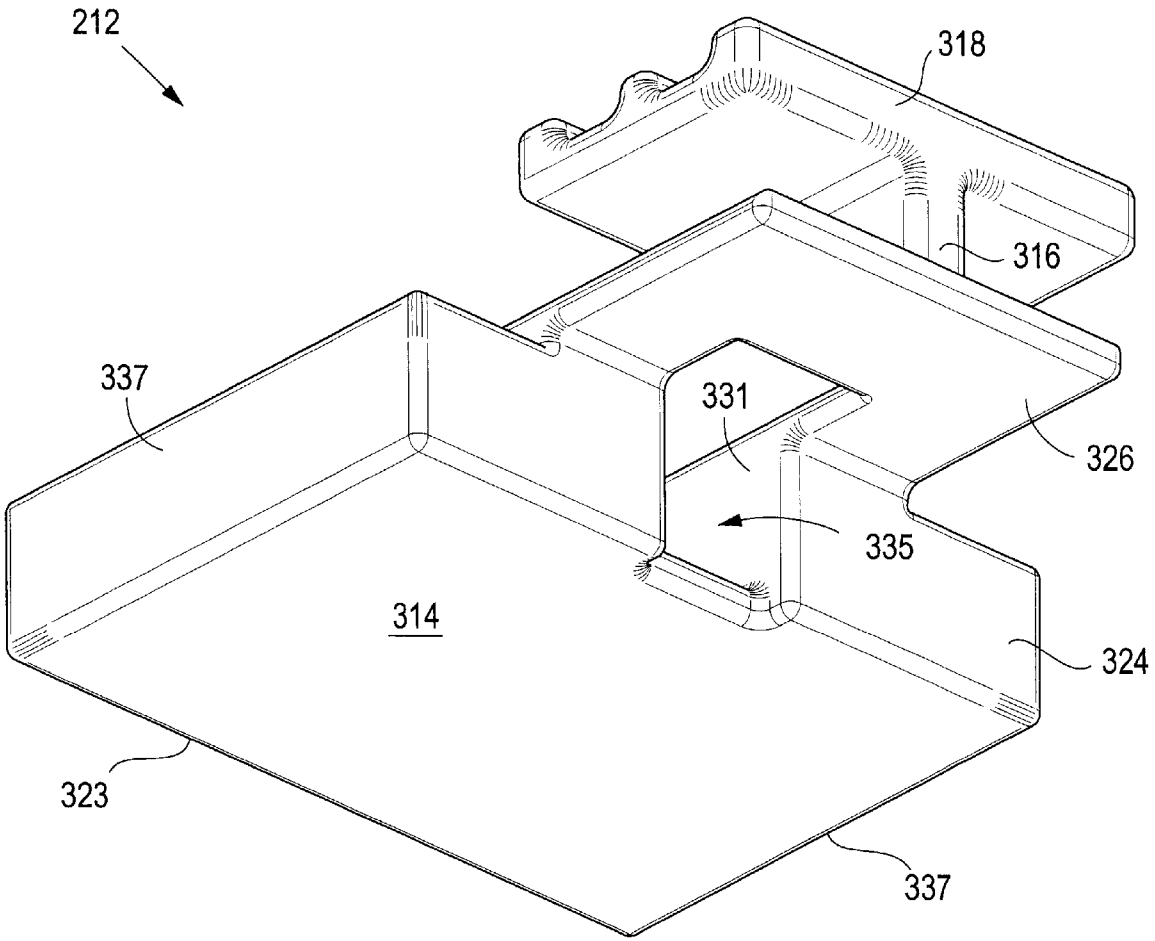
FIG. 13 illustrates an isometric bottom view of a CPA formed in accordance with an alternative embodiment of the present invention.
Figure 14:
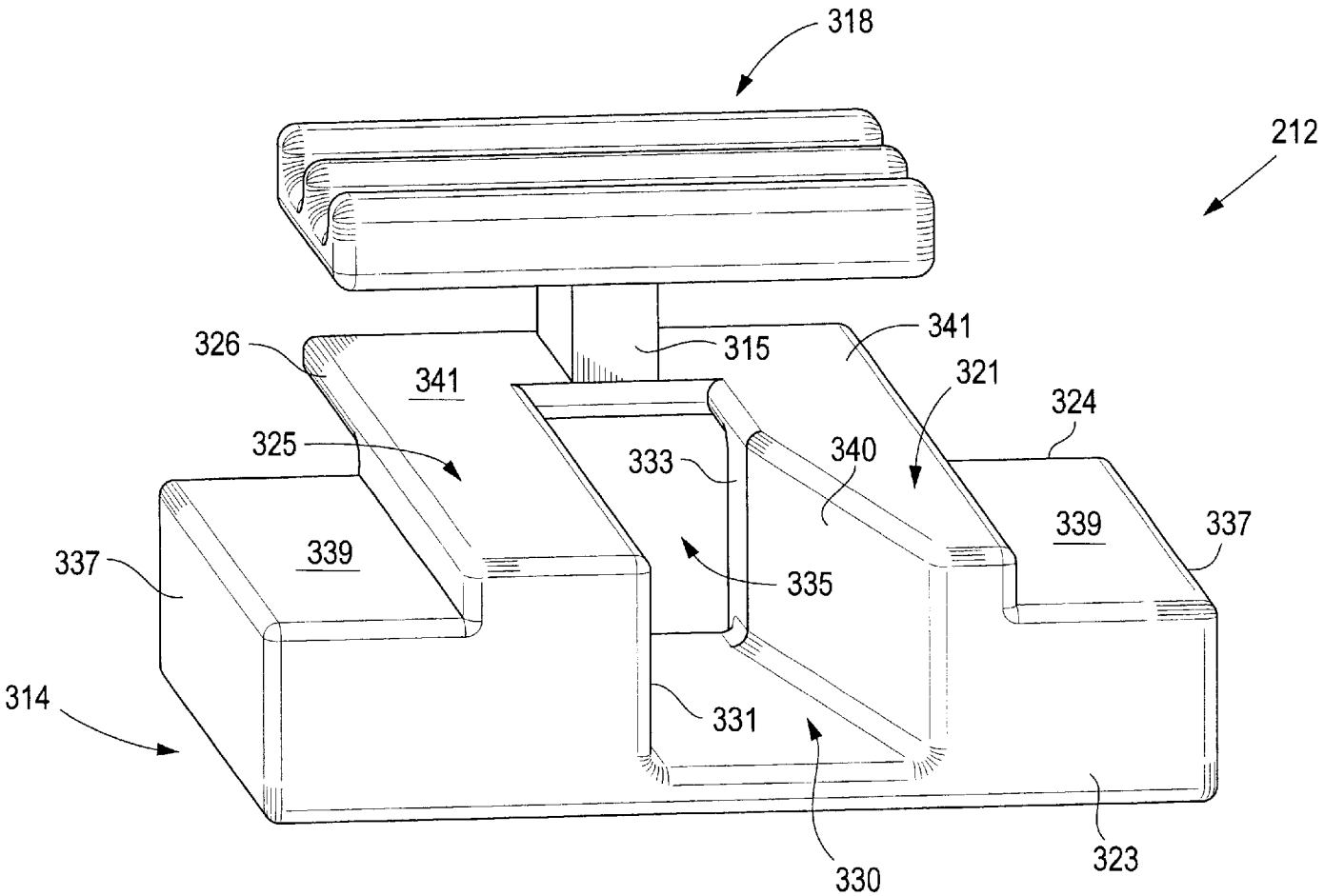
FIG. 14 illustrates an isometric front view of a CPA formed in accordance with an alternative embodiment of the present invention.

FIGS. 12–14 illustrate isometric views of a CPA 212 in accordance with an alternative embodiment. The CPA 212 includes a base 314 having front and rear ends 323 and 324. Raised portions 321 and 325 project upward from the base 314 and extends from the front to the rear ends 323–324. The raised portions 325 include a ledge 326 projecting rearward beyond the end 324. The ledge 326 includes a vertical post 316 extending upward therefrom and having a ribbed platform 318 mounted thereon. The ribbed platform 318 serves as a surface by which a user may engage the CPA 212 to move it between the initial pre-staged and final positions. The CPA 212 also includes a wedge-shaped notch 330 extending backward from the front end 323. The notch 330 includes a flat side 331, a beveled opposed surface 340, and a latch beam blocking surface 333. The rear end of the notch 330 includes an opening 335. The CPA 212 includes side walls 337 and ledges 339 located on either side of the raised portions 321 and 325. The raised portions 321 and 325 include top surfaces 341.

The CPA 212 is configured to fit the header 50 illustrated in FIG. 3. When the CPA 212 is moved to the final locked position, the ledges 339 are located immediately below embossments 110, while top surfaces 341 are located immediately below the under surfaces 111 of the fingers 106. The base 314 of the CPA 212 slides on top of the ledges 90. A V-shaped latching projection 370 is formed on the interior surface of the top wall 100 and directed downward from the shroud 94. The latching projection 370 fits within the latching notch 235 on the latch beam 228.

Figure 15:
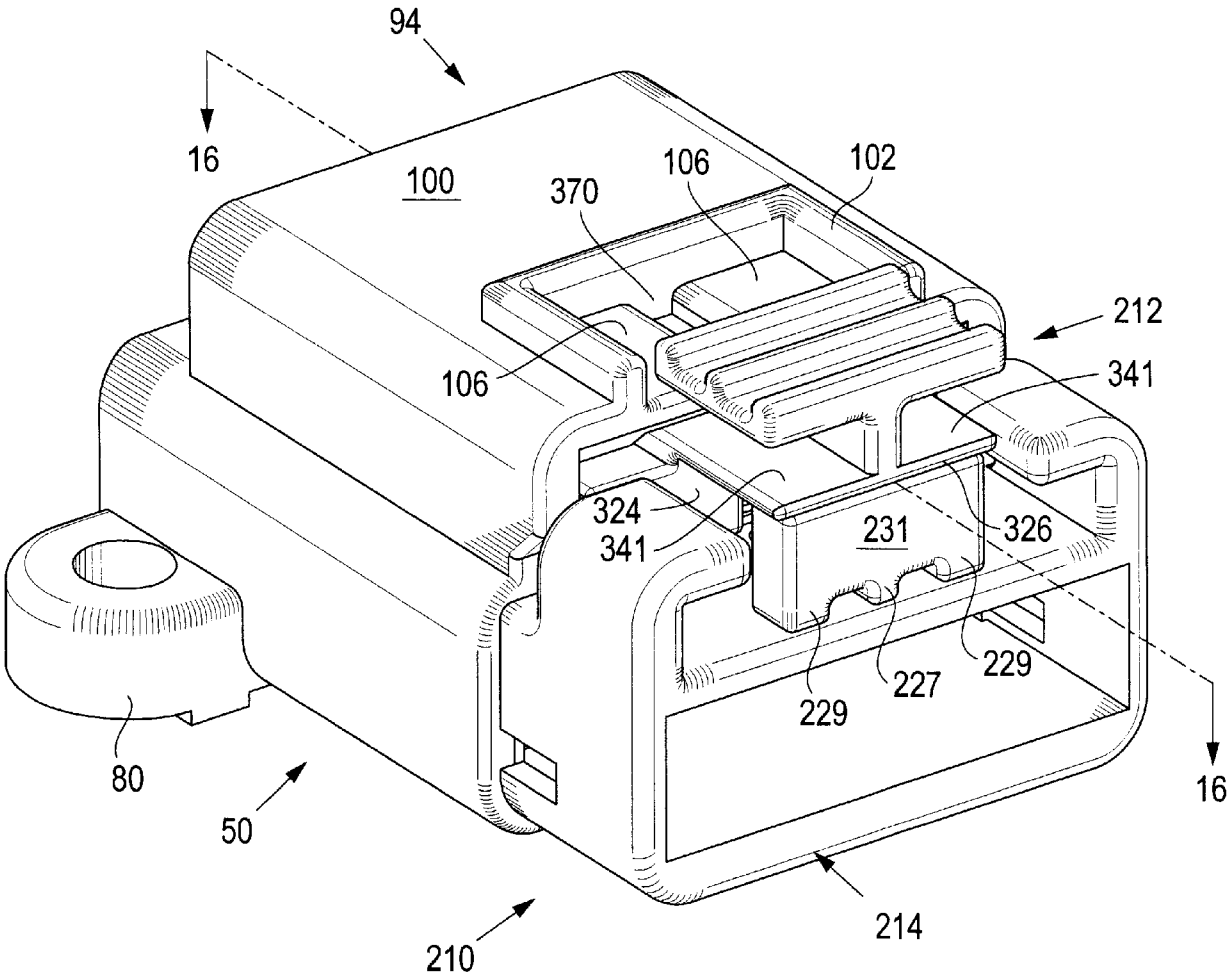
FIG. 15 illustrates an isometric view of a plug, header and CPA in a fully mated, pre-staged position in accordance with an alternative embodiment of the present invention.
Figure 16:
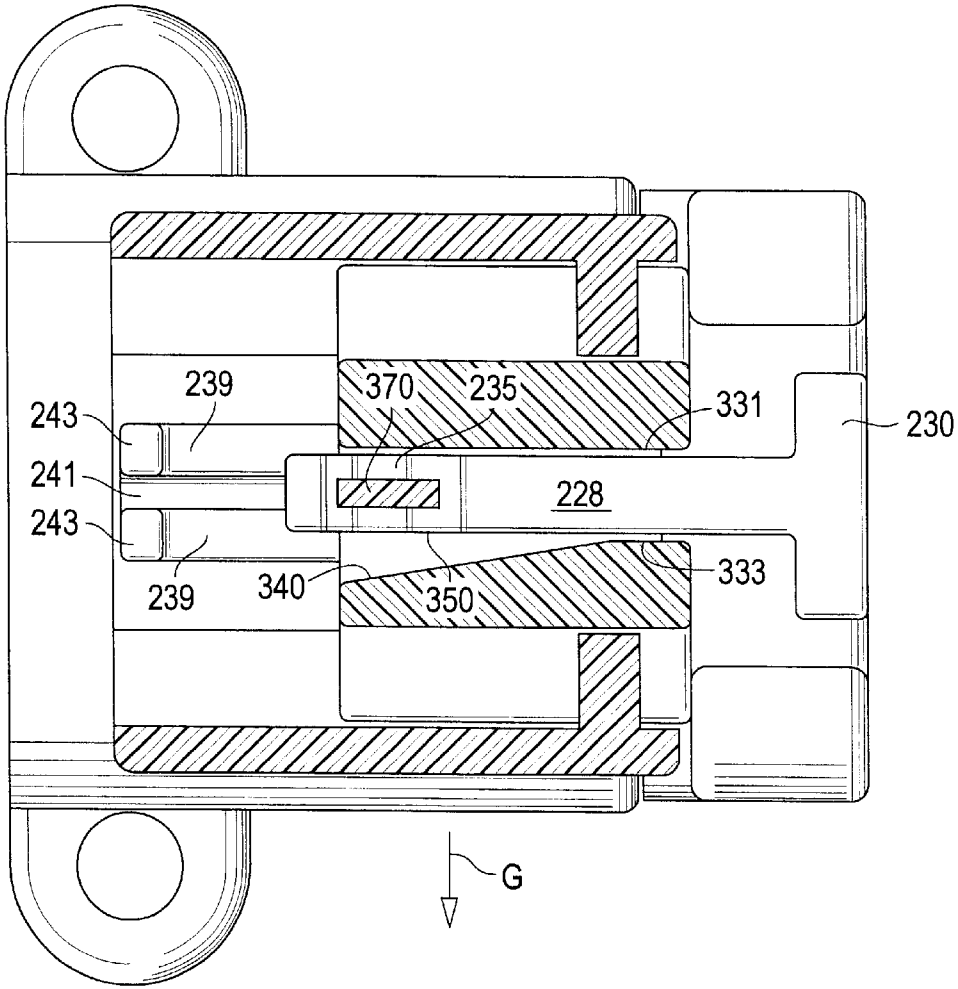
FIG. 16 illustrates a sectional view taken along line 16—16 in FIG. 15 to illustrate a top plan view of the plug, header and CPA of FIG. 15.

FIGS. 15 and 16 illustrate the plug housing 210, and header 50 in a fully mated position and the CPA 212 in an initial pre-staged position. FIG. 16 represents a cross-sectional view taken along line 16—16 in FIG. 15 to provide a top plan view of the overall assembly. When in the initial pre-staged position, the CPA 212 is located such that the blocking surface 333 in notch 330 and opposing portion of the flat side 331 are located immediately adjacent the pivot member 237 about which the latch beam 228 pivots. The beveled surface 340 is located along side, but remote from the interior side surface 350 of the latch beam 228, thereby permitting the latch beam 228 to pivot side ways in the direction of arrow G until the latch projection 236 on the end of the latch beam 228 clears the latch projection 370 on the header 50. The latch beam 228 is then moved to its resting position (as shown in FIG. 16) in which the latching projection 112 resides in the latching notch 235.

Figure 17:
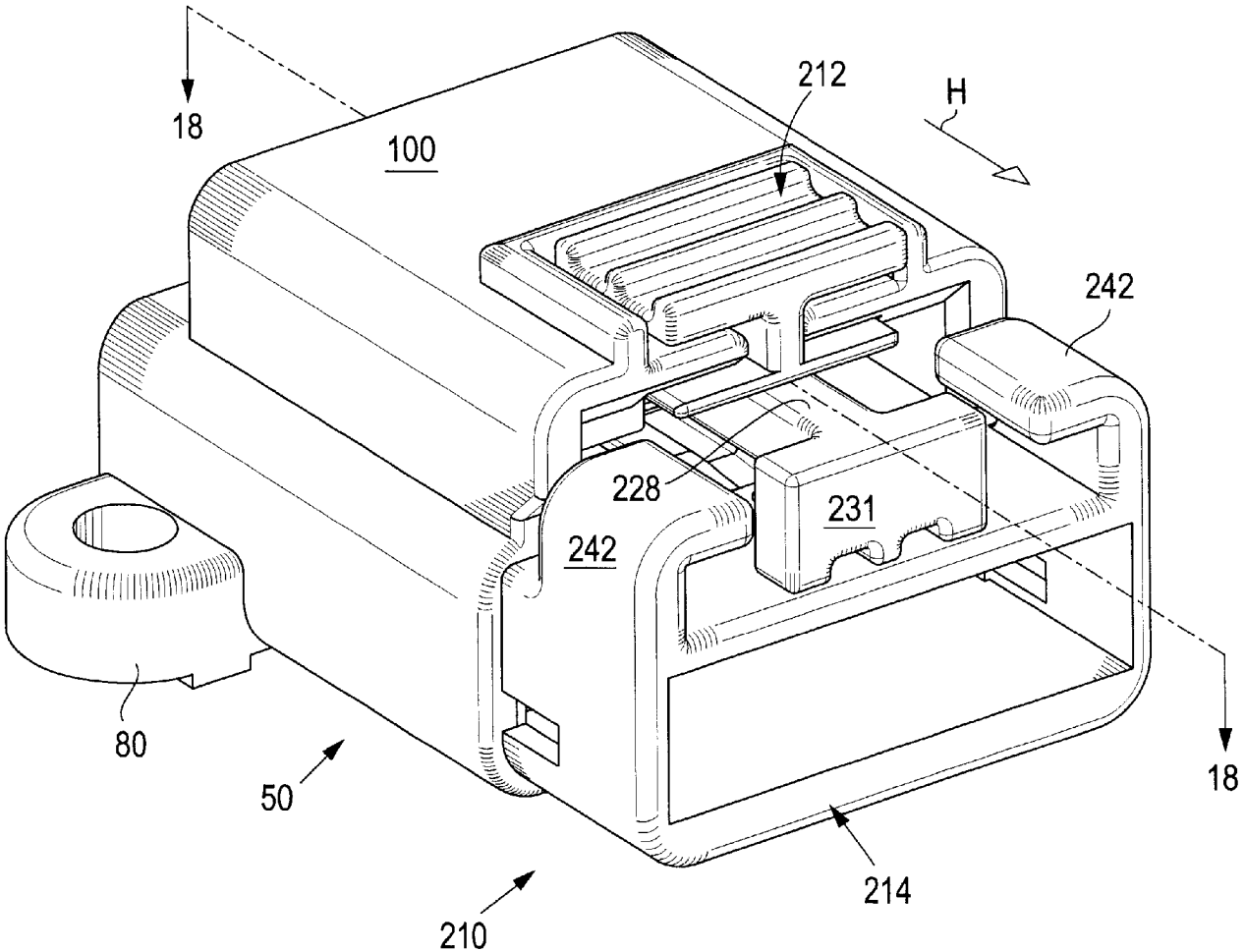
FIG. 17 illustrates a plug, header and CPA while in a fully mated, locked position in accordance with an alternative embodiment of the present invention.
Figure 18:
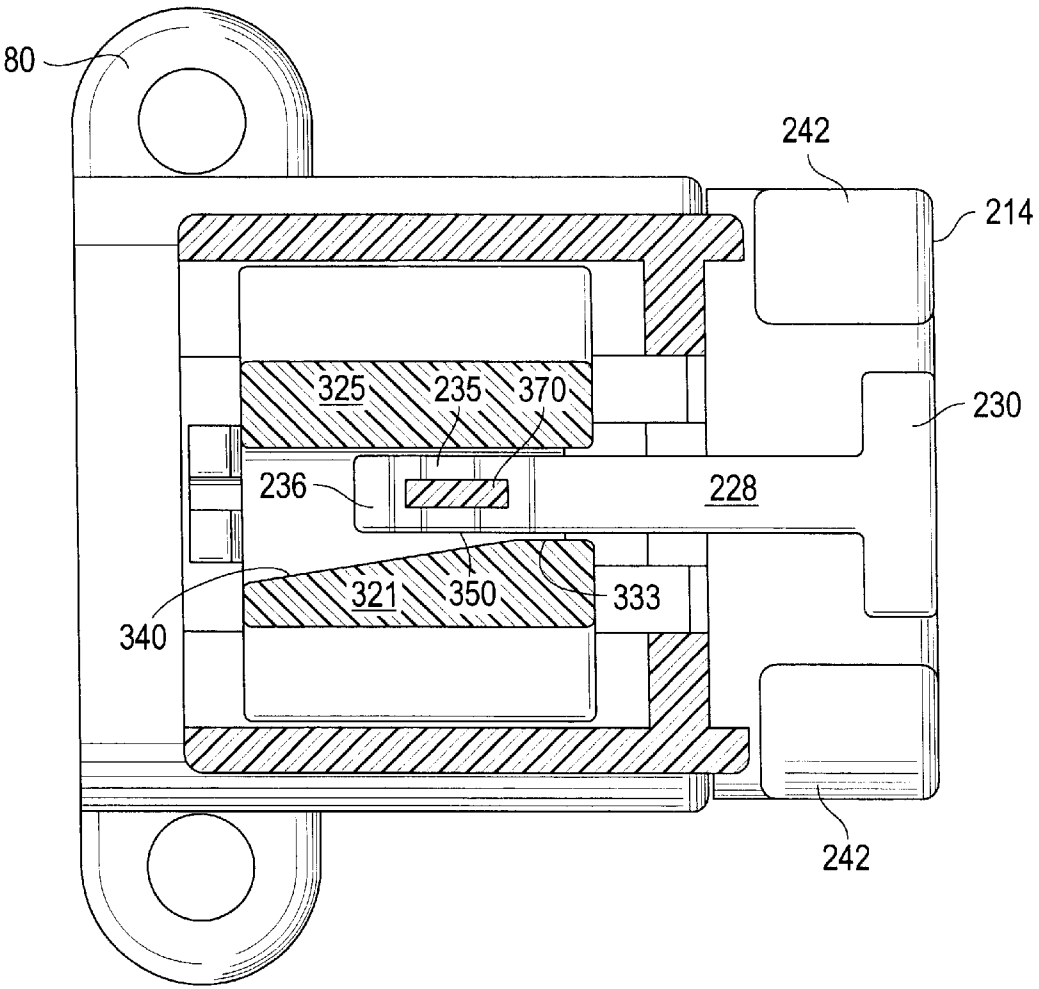
FIG. 18 illustrates a sectional view taken along line 18—18 in FIG. 7 to show a top plan view of the plug, CPA and header in accordance with the embodiment of FIG. 17.

Once the latch beam 228 is deflected back to its rest position, the CPA 212 may be moved to its locking position as shown in FIGS. 17 and 18. FIG. 18 illustrates a cross-sectional view taken along line 18—18 in FIG. 17. When the CPA 212 is slid to its final position the blocking surface 313 is located proximate the distal end 232 of the latch beam 228 near the latching notch 235. The blocking surface 313 is located immediately adjacent and engages the side surface 350 of the latching beam 228 and prevents lateral, side-to-side movement thereof When in its final position, the CPA 212 ensures that the plug housing 210 and header 50 are in a final mated position with one another. To remove the header 50 from the plug housing 210, the CPA 212 is first slid in the direction of arrow H (FIG. 17) back to its initial pre-staged position. Once the CPA 212 is located in its initial pre-staged position, the latch beam 228 may be laterally deflected in the direction of arrow G (FIG. 16) to disengage the latch projection 370 and permit the header 50 and plug housing 210 to be disconnected from one another.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector assembly including first and second connector housings arranged along a connector assembly longitudinal axis and a connector position assurance device (CPA), said first and second connector housings each having a rear end and a mating end located along said longitudinal axis, said assembly comprising:

a deflectable latch assembly mounted on an exterior surface of one of said first and second connector housings, said exterior surface being oriented perpendicular to the mating end, said latch assembly including at least one latch beam, said latch beam being deflectable from side-to-side relative to said exterior surface and along an axis transverse to said longitudinal axis between latched and unlatched positions; and the CPA having a beam blocking portion movable between first and second positions relative to said latch beam, said beam blocking portion being spaced laterally remote from said latch beam when in said first position to permit lateral deflection of said beam along said transverse axis, said beam blocking portion being moved to a position immediately adjacent said latch beam when in said second position to prevent lateral deflection of said latch beam along said transverse axis;

wherein said beam blocking portion is received between two latch beams, said beam blocking portion permitting said latch beams to be laterally deflected inward toward one another while said CPA is in said first position and contacting inner surfaces of said latch beams to block lateral deflection when in said second position.

2. The electrical connector housing assembly of claim 1, wherein said latch beams are formed at one end of a plug connector housing, said latch beams extending parallel to said longitudinal axis when in a resting position and being laterally deflectable away from one another in opposite directions along said transverse axis.

3. The electrical connector housing assembly of claim 1, wherein at least one of said latch beams includes a latch member that latches with an associate latch element on another one of said first and second connectors housings when in a resting non-deflected position, said latch member moving along said axis to engage and disengage said associate latch element.

4. The electrical connector housing assembly of claim 1, said first and second connector housings including a header and a plug that mate with one another.

5. The electrical connector housing assembly of claim 1, one of said first and second connector housings including a header having a pair of latch projections spaced apart from one another along said transverse axis, said at least one latch beam including latching projections formed on opposed outer sides thereof and arranged to be biased outward into an engaging relation with said latch projections when said first and second connector housings are fully mated with one another.

6. The electrical connector housing assembly of claim 1, one of said first and second connector housings including a header having a pair of latch elements extending downward from an interior surface of a top wall of said header, said at least one beam including a pair of beams having latching projections arranged to be biased into an engaging relation with said latch elements when said pair of beams are located in resting non-deflected positions.

7. The electrical connector housing assembly of claim 1, wherein said latch beam includes two beams each having front and back portions, said back portions being flared away from one another to define a CPA pre-staging area therebetween holding said CPA while in said first position, said front portions defining a CPA fully mated area therebetween holding said CPA while in said second position.

8. The electrical connector assembly of claim 1, wherein said CPA includes a wedge-shaped body extending toward said mating end.

9. An electrical connector assembly that includes a header, a connector position assurance device (CPA), and a plug, said header and plug having mating ends and rear ends and including at least one contact interconnection therebetween, said assembly comprising:

a plug/header latch assembly mounted to one of said plug and header, said latch assembly having at least one latch arm normally biased in a first latch position and pivotal along an arcuate path to a second latch position to engage and disengage a latch member on another one of said header and plug when moved between said first and second positions, respectively, said latch assembly being disposed on a an external surface of said one of said plug and header, said exterior surface being oriented perpendicular to the mating end;

a CPA slidably mounted to one of said plug and header and movable between first and second CPA positions relative to said latch assembly; and said CPA being moved along a length of said at least one latch arm when moved between said first and second CPA positions, said CPA being spaced from said latch arm when in said first CPA position permitting said latch arm to move to said second latch position, said CPA being moved to a position immediately adjacent said latch arm when in said second CPA position blocking movement of said at least one latch arm from said first latch position;

wherein said at least one latch arm includes a pair of latch arms formed on one end of the plug, said latch arms extending parallel to one another along the length of the plug, said latch arms being laterally deflectable along arcuate paths away from one another when moving between said first and second latch positions.

10. The electrical connector housing assembly of claim 9, wherein said CPA and said at least one latch arm remain in a common horizontal plane throughout deflection and while moved between corresponding first and second CPA and latch positions.

11. The electrical connector assembly of claim 9, wherein said at least one latch arm includes a latch member that securely joins to an associated latch element on another one of the plug and header when the latch arm is in said first latch position, said latch member engaging and disengaging said latch element when moving laterally along said arcuate path between said first and second latch positions.

12. The electrical connector assembly of claim 9, wherein one of said plug and header include a pair of latch projections spaced apart from one another along said arcuate path, said at least one latch arm including a pair of latch arms having latch projections formed on opposed outer sides thereof and arranged to be biased outward into an engaged relation with said latch projections when the plug and header are fully mated with one another.

13. The electrical connector assembly of claim 9, wherein said at least one latch arm includes two beams each having front and back portions, said back portions being flared away from one another to define a CPA pre-staging area therebetween holding said CPA while in said first position, said front portions defining a CPA fully mated area therebetween holding said CPA while in said second position.

14. The electrical connector assembly of claim 9, wherein said CPA includes a wedge-shaped body extending toward said mating end.

15. The electrical connector assembly of claim 9, wherein said CPA includes a beam blocking portion received between two latch arms, said beam blocking portion permitting said latch arms to be laterally deflected inward toward one another while said CPA is in said first position, said beam blocking portion contacting inner surfaces of said latch arms to block lateral deflection while said CPA is in said second CPA position.

* * * * *